US010012097B2

(12) United States Patent
Prestel et al.

(10) Patent No.: US 10,012,097 B2
(45) Date of Patent: Jul. 3, 2018

(54) ANTI-ROTATION NOZZLE SECTOR AND METHOD FOR MANUFACTURING SUCH A SECTOR

(71) Applicant: Snecma, Paris (FR)

(72) Inventors: Sébastien Jean Laurent Prestel, Coubert (FR); Denis Aydin, Paris (FR); Rémi Blanc, Maison Alfort (FR); Hélène Condat, Limeil-Brevannes (FR); Patrice Jean-Marc Rosset, La Chapelle Gauthier (FR)

(73) Assignee: SNECMA, Paris (FR)

( * ) Notice: Subject to any disclaimer, the term of this patent is extended or adjusted under 35 U.S.C. 154(b) by 343 days.

(21) Appl. No.: 14/767,183

(22) PCT Filed: Feb. 19, 2014

(86) PCT No.: PCT/FR2014/050342

§ 371 (c)(1),
(2) Date: Aug. 11, 2015

(87) PCT Pub. No.: WO2014/128403

PCT Pub. Date: Aug. 28, 2014

(65) Prior Publication Data

US 2015/0377047 A1 Dec. 31, 2015

(30) Foreign Application Priority Data

Feb. 19, 2013 (FR) ..... 13 51402

(51) Int. Cl.

| | |
|---|---|
| ***F01D 9/04*** | (2006.01) |
| ***F01D 25/24*** | (2006.01) |
| ***F01D 11/00*** | (2006.01) |

(52) U.S. Cl.
CPC ..... *F01D 9/04* (2013.01); *F01D 9/042* (2013.01); *F01D 11/005* (2013.01);
(Continued)

(58) Field of Classification Search
CPC ..... F01D 9/04; F01D 11/005; F01D 25/246; F05D 2220/323; F05D 2230/238; F05D 2230/60
See application file for complete search history.

(56) References Cited

U.S. PATENT DOCUMENTS 5,201,846 A * 4/1993 Sweeney ..... F01D 9/04 415/170.1
5,232,340 A 8/1993 Morgan
(Continued)

FOREIGN PATENT DOCUMENTS

| | | |
|---|---|---|
| DE | 10 2009 003 638 A1 | 10/2009 |
| DE | 10 2011 055 838 A1 | 5/2012 |
| FR | 2 960 591 A1 | 12/2011 |

OTHER PUBLICATIONS

International Search Report issued in Application No. PCT/FR2014/050342 dated Jun. 3, 2014.
(Continued)

*Primary Examiner* — Mark Laurenzi
*Assistant Examiner* — Shafiq Mian
(74) *Attorney, Agent, or Firm* — Pearne & Gordon LLP

(57) ABSTRACT

A nozzle sector of an aircraft turbo-machine, including a hooking member (64) having a projection (70, 70*a*, 70*b*) radially extending towards the outside of the sector, a recess (72) being provided through at least one part of a distal end of the projection (70, 70*a*, 70*b*), the recess (72) being configured to accommodate a shoulder member (74) forming a stop for a surface of an adjacent sector (26).

13 Claims, 5 Drawing Sheets

(52) U.S. Cl.
CPC ..... *F01D 25/243* (2013.01); *F01D 25/246* (2013.01); *F05D 2220/323* (2013.01); *F05D 2230/18* (2013.01); *F05D 2230/238* (2013.01); *F05D 2230/60* (2013.01); *F05D 2230/644* (2013.01); *F05D 2240/125* (2013.01)

(56) References Cited

U.S. PATENT DOCUMENTS

| | | | | |
|---|---|---|---|---|
| 5,318,405 | A * | 6/1994 | Meade | F01D 5/3015 416/220 R |
| 6,672,833 | B2 * | 1/2004 | MacLean | F23R 3/50 415/116 |
| 6,742,987 | B2 * | 6/2004 | Correia | F01D 9/042 415/189 |
| 6,895,757 | B2 * | 5/2005 | Mitchell | F01D 11/005 60/753 |
| 6,901,821 | B2 * | 6/2005 | Torrance | F01D 9/04 403/20 |
| 7,234,920 | B2 * | 6/2007 | Imbourg | B22F 3/15 29/889.2 |
| 7,237,388 | B2 * | 7/2007 | Aumont | F01D 9/023 60/753 |
| 8,206,096 | B2 * | 6/2012 | Prentice | F01D 5/282 415/191 |
| 2004/0213673 | A1 | 10/2004 | Tsuru | |
| 2009/0110549 | A1 * | 4/2009 | Snook | F01D 11/005 415/191 |
| 2009/0246012 | A1 | 10/2009 | Shapiro | |
| 2012/0134791 | A1 | 5/2012 | Brunt | |
| 2013/0078086 | A1 | 3/2013 | Breugnot | |
| 2014/0050564 | A1 * | 2/2014 | Hagan | F01D 11/001 415/116 |

OTHER PUBLICATIONS

Written Opinion issued in Application No. PCT/FR2014/050342 dated Jun. 3, 2014.
Search Report issued in French Patent Application No. FR 1351402 dated Nov. 6, 2013.

* cited by examiner

ANTI-ROTATION NOZZLE SECTOR AND METHOD FOR MANUFACTURING SUCH A SECTOR

TECHNICAL FIELD

The invention relates to a low pressure turbine element for an aircraft turbojet. More particularly, the invention is about a structure of a hooking means for a nozzle sector of a low pressure turbine. The invention also relates to the method for manufacturing such a structure.

STATE OF PRIOR ART

A low pressure turbine includes several successive expansion stages. Each of these stages has a runner (rotor) and a fixer wheel (also referred to as a nozzle, a stator, or a grate).

FIGS. 1A and 1B illustrate a detail of such a low pressure turbine 8 having an upstream-downstream longitudinal orientation A. A runner 10 and a nozzle 12 of the upstream expansion stage are shown here. Each nozzle 12 is subdivided into radial sectors 16 which each carry a plurality of stationary vanes 20. The radial sectors 16 are each secured on a casing 14 at the end thereof farthest from the centre axis by an outer annular platform 18. Here, the platform 18 has, upstream and downstream, a hooking means 22 and 24 on the casing 14.

The downstream hooking means 24 of a sector 16, are more particularly described, with reference to FIGS. 2 and 3.

The means 24 include two annular rims 28 and 30.

The rim 28 extends angled, towards the outside of the turbine and downstream (that is upwards and towards the right side of FIGS. 2 and 3).

The rim 30 here extends towards the outside, beyond the rim 28, and also downstream. The rim 30 includes a radial portion 30*a* and an axial portion 30*b*.

The radial portion 30*a* includes two upstream and downstream radial surfaces, respectively 38*a* and 38*b*.

The portion 30*b* extends as a cornice from the distal end of the portion 30*a*, transversely and downstream. The portion 30*b* includes two outer and inner annular surfaces, respectively 40*a* and 40*b*.

A recess 32 is provided on the ridge formed by the surfaces 38*a* and 40*a*. This recess 32 forms a housing for a slug secured on the casing and which acts as an anti-rotation stop for the nozzle sector 16.

A shoulder 34 is provided protruding from the surfaces 38*b* and 40*b*, facing the recess 32. The shoulder includes two end surfaces 42*a* and 42*b*, opposite each other and being each transverse to both surfaces 38*b* and 40*b*.

The shoulder 34 axially stretches up to an end surface 38*c* of the portion 30*b*. The shoulder 34 finally includes a lower surface 40*c*.

Alternatively, the shoulder 35 illustrated in FIGS. 1A and 1B slightly differs in shape from the shoulder 34.

With reference to FIGS. 1A and 1B, an element 26 referred to as a sealing sector is described. The sealing sector 26 particularly includes a longitudinal sector element 26*a*, a U-shaped cross-section fastener 26*b* and a projection 27 carried on the inner part of the fastener 26*b*.

The shoulder 34 is provided to cooperate with the projection 27 (FIG. 1B), thus immobilizing the sealing sector 26 in the turbine 8.

For an optimum cooperation between the sector 16 and the sealing sector 26, it is desirable to limit to a maximum the radius of curvature at the junctions between the faces 42*a* and 38*b* on the one hand, and between the faces 42*a* and 40*b* on the other hand.

Similarly, it is desirable to limit to a maximum the radius of curvature between the faces 42*b* and 38*b*, and between the faces 42*b* and 40*b*.

The desired radius of curvature is here ideally lower than 0.35 mm, in order to maximize among other things the shear contact surface between the nozzle 12 sector 16 and the sealing sector 26. However, the conventional tools of the milling cutter or grinding wheel type do not enable such a fine machining to be reached.

From a rough casting, certain surfaces of the rim 30 are machined by resurfacing (that is using a grinding wheel) and other surfaces by electrical discharge machining (EDM). More precisely, the surfaces 40*a* and 38*c* are processed by resurfacing, and the inner surfaces of the recess 32 as well as the surfaces 38*b*, 40*b*, 40*c*, 42*a*, and 42*b* are EDM machined.

Nevertheless, if the EDM machining enables the desired accuracy to be reached, this method creates a significant wear of the electrode ends which need to be very often reshaped in order to maintain the machining quality of this area, in particular of the inner ridges.

A further drawback of the present solution is that it requires a considerable volume of the material in which the shoulder is machined.

The present method therefore has considerable technical constraints and a high cost. The aim of the invention is to provide a simple to implement, efficient and inexpensive alternative to an anti-rotation shoulder such as described above.

DISCLOSURE OF THE INVENTION

The invention thus relates to a nozzle sector of an aircraft turbomachine, including an at least partially annular hooking member and a shoulder member, the hooking member having a projection radially extending towards the outside of the sector, a recess being provided through at least one part of the distal end of the projection, the recess accommodating, the shoulder member, the latter forming an anti-rotation stop for a surface of an axially adjacent sector.

Advantageously, the shoulder member can be mounted and secured in the recess before assembling the nozzle sector in the turbomachine, for example by welding, crimping, or soldering.

By providing a recess intended to accommodate a shoulder-forming insert on such a sector, machining can be simplified into a single method of the resurfacing or milling type, thus reducing the manufacturing cost and time of the piece. The radius of curvature between the contact surface of the shoulder and the surfaces which are transverse thereto can also be improved. The cost and the adjustment time of the electrodes imposed by the EDM are furthermore avoided without a performance loss.

Advantageously, the projection has a radial portion and an axial portion extending from a distal end of the radial portion, the recess being provided through at least one part of the axial portion.

In a particular embodiment of the invention, said adjacent sector is a sealing sector.

According to a particular feature of the invention, the shoulder member radially protrudes towards the inside of the distal end of the projection.

The shoulder member of the sector works in shear. Thus, an economical method of the welding, crimping, or soldering type is enough to provide the operating performance.

The invention also relates to a shoulder member for a nozzle sector of an aircraft turbo-machine such as described above, the shoulder member having a contact surface with a predetermined orientation, configured to form an anti-rotation stop for a corresponding surface of an adjacent sector and along a direction transverse to a longitudinal direction of the turbomachine.

Such a shoulder member is economical to manufacture. The inner ridges of an assembly between such a shoulder member and the accommodating sector can be advantageously obtained by grinding or milling with a radius of curvature near zero therefore much better than the presently used EDM method, which enables the functional contact surfaces between the shoulder and the transverse surfaces belonging to the nozzle sector to be increased.

According to an advantageous feature, the shoulder member includes a first part with a width substantially identical to the recess and a second part with a width greater than the first part.

Thus, the shoulder member can be used as a both economical and simple to manufacture alternative to the shoulder described in the preamble which is machined in a single piece with a nozzle sector, with the part having a lesser width being mounted in the recess and the widest part acting as a shoulder.

Advantageously, said contact surface is provided on the second part of the shoulder member.

The invention also relates to a method for manufacturing a nozzle sector of an aircraft turbomachine comprising the following steps:

- a step of machining, for example by resurfacing, grinding or milling, a surface of a projection of said sector, said projection surface being configured to form an inner ridge with a contact surface of a shoulder member,
- machining a recess through at least one part of a distal end of the projection,
- manufacturing said shoulder member,
- assembling said shoulder member with the sector, in said recess.

The shoulder member is manufactured independently of the sector.

The step of machining the projection surface and the step of manufacturing said shoulder member can be performed without a particular order.

Advantageously, the above described manufacturing method, includes a step of machining a recess by resurfacing, grinding or milling, at least one part of the recess being configured to accommodate a stop-forming shoulder member for a surface of an adjacent sector.

Advantageously, the shoulder member is secured in the recess by welding, crimping, or soldering.

The invention finally relates to an aircraft turbomachine including a nozzle sector such as previously described.

BRIEF DESCRIPTION OF THE DRAWINGS

The invention will be better understood and further characteristics, details, and advantages thereof will appear more clearly upon reading the following description, made by way of non-limiting example and with reference to the appended drawings, in which.

DETAILED DISCLOSURE OF PARTICULAR EMBODIMENTS

Figure 4:
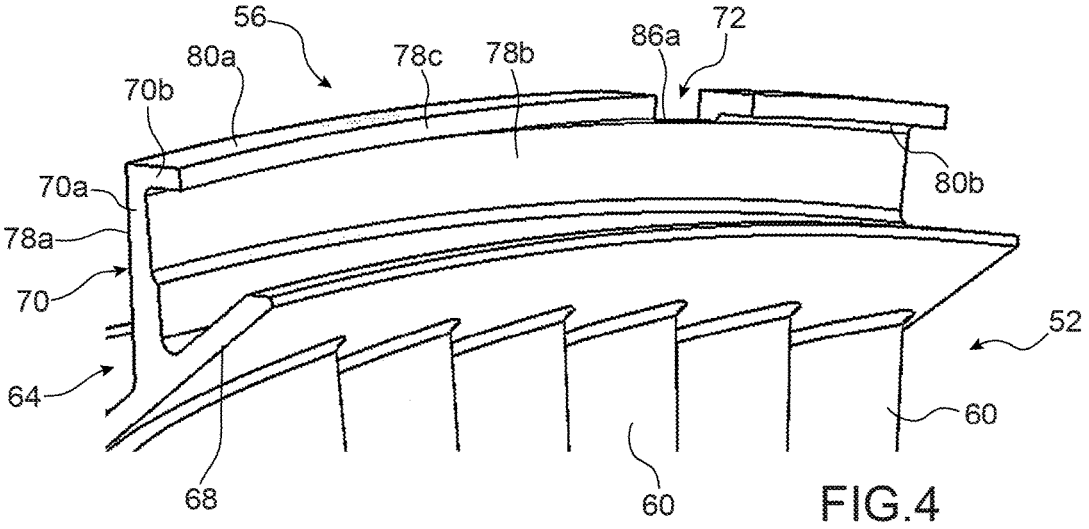
FIG. 4 is a perspective view of a first part of an improved hooking means for a low pressure nozzle sector.

FIG. 4 illustrates a nozzle 52 sector 56 which has a plurality of vanes 60.

The sector 56 has downstream hooking means 64. These means 64 have two rims 68 and 70.

The rim 68 extends angled, towards the outside of the turbine and downstream (that is upwards and towards the right side of FIG. 4).

The rim 70 includes a radial portion 70*a* and an axial portion 70*b*.

The radial portion 70*a* includes two upstream and downstream radial surfaces, respectively 78*a* (FIG. 7) and 78*b* (FIG. 4).

The portion 70*b* extends as a cornice from the distal end of the portion 70*a*, transversely and downstream up to an end surface 78*c*. The portion 70*b* includes two outer and inner annular surfaces, respectively 80*a* and 80*b*. The radial thickness of the portion 70*b* between the surfaces 80*a* and 80*b* is here constant throughout the angular extent of the sector 56.

A recess 72 is provided across the axial portion 70*b* (FIG. 4).

The recess 72 axially extends from the surface 78*a* up to the end surface 78*c*, that is it longitudinally passes throughout the axial portion 70*b*. The recess 72 further radially extends from the surface 80*a* up to a bottom surface 86*a*, which is here planar, over a height greater than the radial thickness of the portion 70*b*. The recess 72 also has two opposite side surfaces 88*a* and 88*b* which are here parallel.

A shoulder member, here the wedge 74, is provided to be mounted on the rim 70 (FIG. 6) thus forming an anti-rotation shoulder.

Figure 5A:
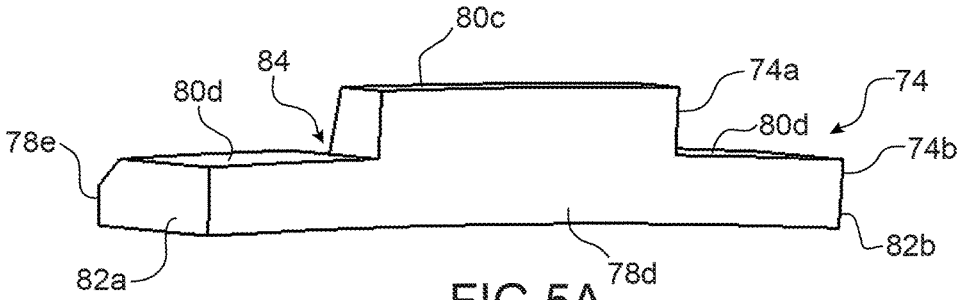
FIG. 5A is a perspective view of a wedge of an improved hooking means, which is inserted and complementary to the first part shown in FIG. 4.

The wedge 74 is here made in a single piece with a top part 74*a* and a bottom part 74*b* (respectively at the top and the bottom of FIG. 5A). The top part 74*a* has a width lower than the bottom part 74*b*.

The top part 74*a* is provided to be mounted in the recess 72.

Figure 6:
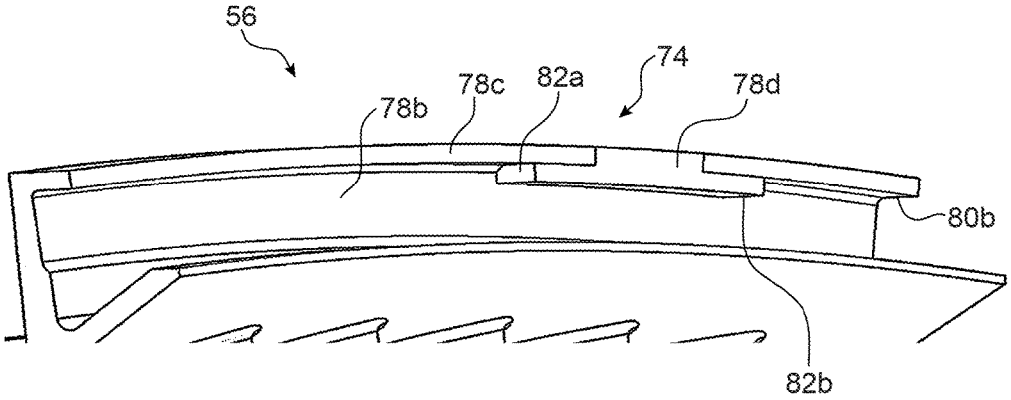

The top part 74*a* has here a height equal to the thickness of the axial portion 70*b*. Thus, when the wedge 74 is mounted on the rim 70, an upper surface 80*c* of the top part 74*a* is coextensive with the outer surface 80*a*, whereas an upper surface 80*d* of the bottom part 74*b* is flat against the inner surface 80*b*. Moreover, a T-shaped planar surface 78*d*, shared by the top and bottom parts 74*a* and 74*b*, is coextensive with the end surface 78*c* of the axial portion 70*b*, whereas a surface 78*e* of the bottom part 74*b* is flat against the surface 78*b* of the radial portion 70*a* (FIG. 6).

Figure 1A:
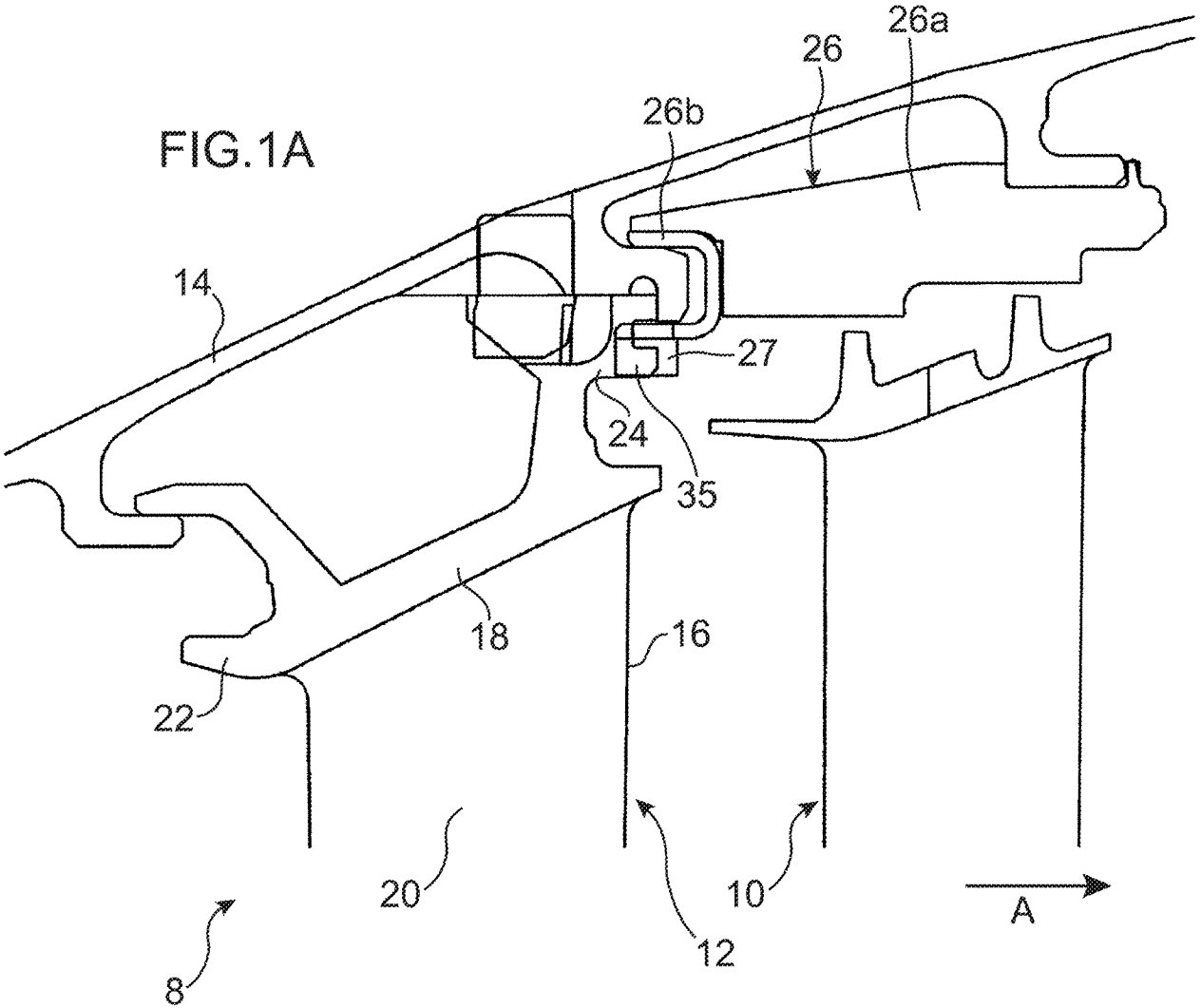
FIG. 1A is a cross-section view of a part of a low pressure turbine showing hooking means carried by an end of a prior art nozzle sector, and cooperating with a projection of an adjacent sealing sector.
Figure 1B:
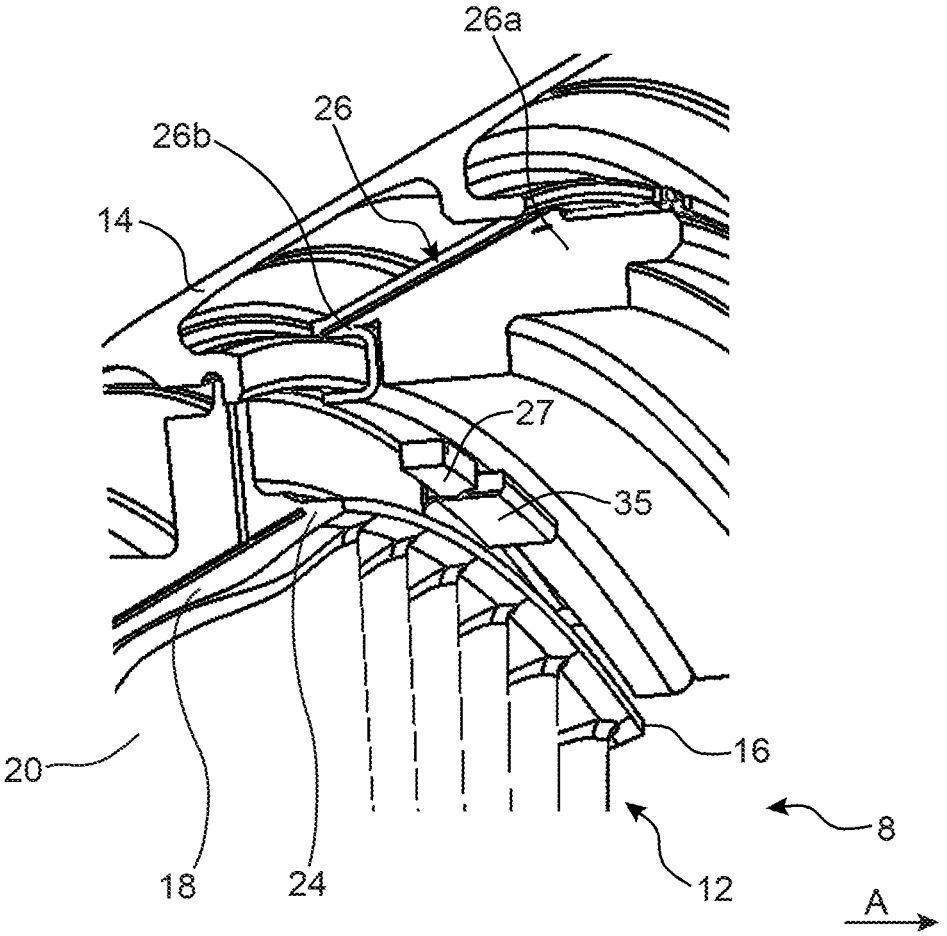
FIG. 1B is a perspective view of the turbine part of FIG. 1A.

The bottom part 74*b* of the wedge 74 laterally extends between two end surfaces 82*a* and 82*b* (FIG. 5A). The surface 82*a* is intended to contact a corresponding surface of the anti-rotation projection 27 of the sealing sector 26 shown in FIGS. 1A and 1B. The surface 82*a* can have for example, but not exclusively, a radial or slight angle orientation relative to a radial orientation. Alternatively, the surface 82*a* may be replaced by another structure (not shown), such as a hooking means, a surface with a slug or other means allowing a reliable contact between the sector 56 and the sealing sector 26.

Figure 5B:
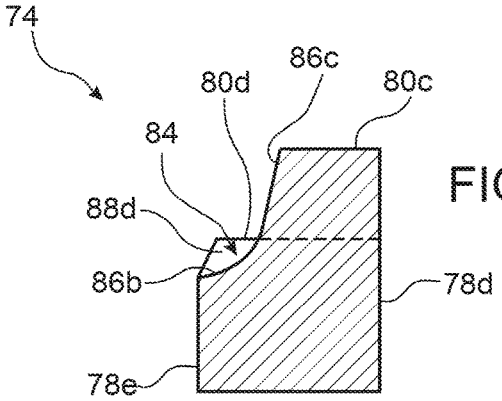
FIG. 5B is a vertical cross-section view of a middle part of the wedge of FIG. 5A; and, FIGS. 6 and 7 are perspective views from two different angles of the parts of the hooking means of FIGS. 4 and 5 in the assembled condition.
Figure 7:
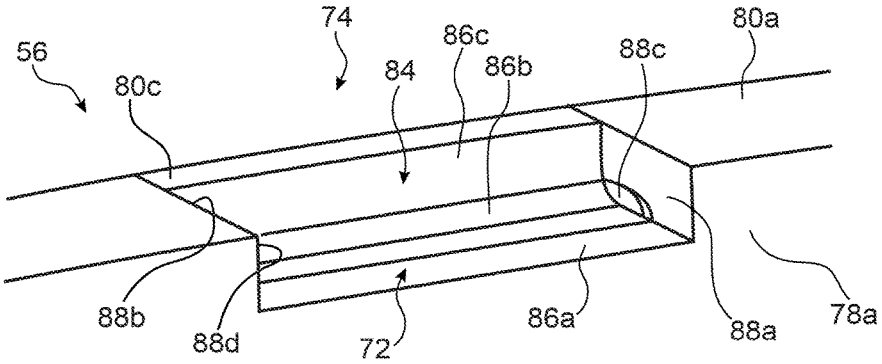

The wedge 74 itself has a recess 84 provided in the bottom part 74*b* (FIGS. 5B and 7). This recess 84 is delimited by a curved bottom surface 86*b*, the latter being lined with two side surfaces 88*c* and 88*d*. The surfaces 88*c* and 88*d* are arranged to come into the plane of the surfaces 88*a* and 88*b* respectively.

A planar surface 86*c* here extends from the bottom surface 86*b*, tangentially thereto and angled up to the upper surface 80*c*. The surface 86*b* is here provided to be tangentially coextensive with the bottom surface 86*a* of the recess 72.

Figure 2:
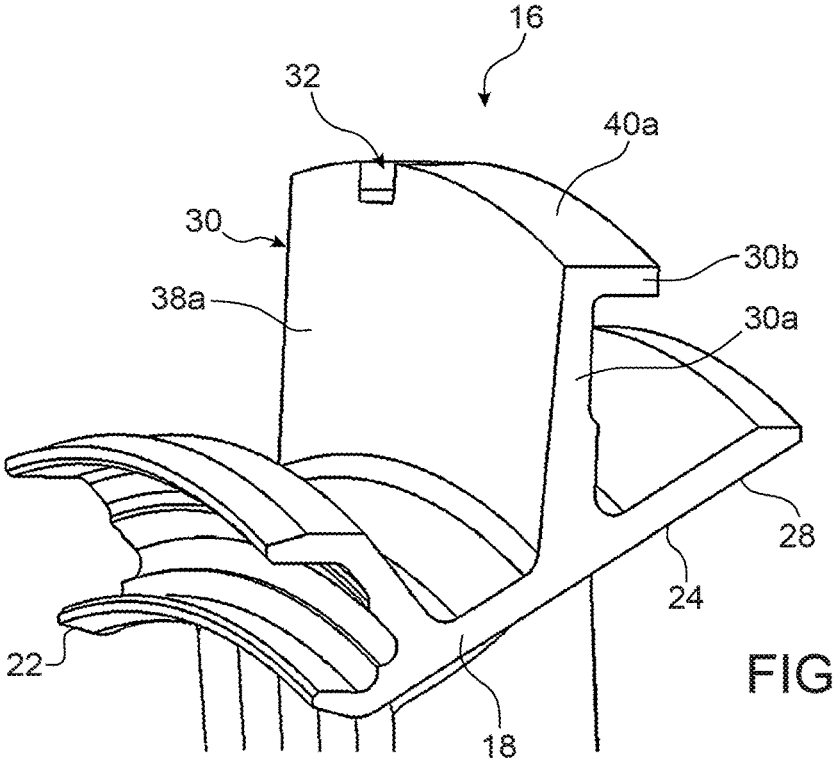
FIGS. 2 and 3 are perspective views from two different angles of alternative downstream hooking means comprised by the prior art low pressure nozzle sector.
Figure 3:
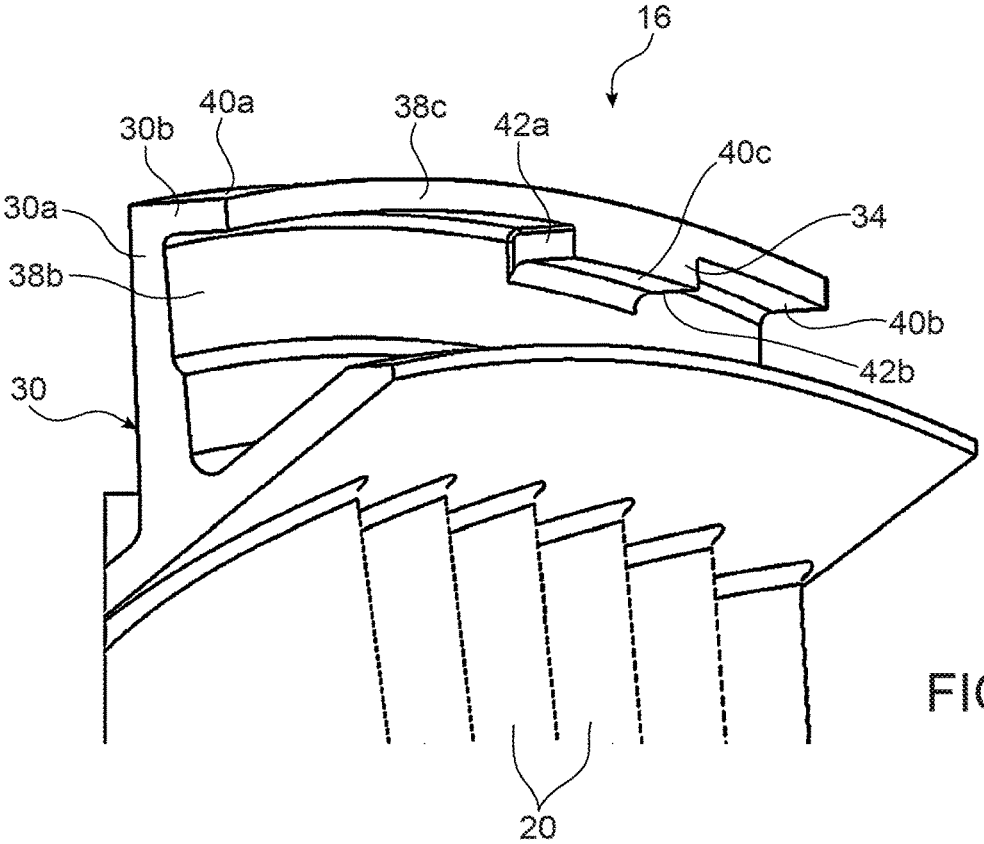

The recess 84 and the recess part 72 which is not obstructed by the wedge 74 form together a hollow having dimensions similar to the recess 32 shown in FIG. 2.

The connection between the sector 56 and the wedge 74 does not have to be as robust as in the case of the shoulder 34 formed in a single piece with the sector 16. Indeed, the wedge 74 works in shear (and not in tension). Thus, the wedge 74 can be sealingly secured to the sector 56 by a connection of the crimping, soldering, or welding type or by any other method while ensuring the desired mechanism strength and the functions of the sector 16 described in the preamble.

Advantageously, and unlike the surfaces of the recess 32 which are EDM machined, the surfaces of the recess 72, as well as the downstream surface 78*b* of the rim 70 and the inner surface 80*b* of the axial portion 70*b*, can be machined before placing the wedge 74, by an economical means such as resurfacing.

It is also possible to form the outer surfaces of the wedge 74 by resurfacing, especially the surface 82*a*.

Manufacturing the sector 56 can thus include the following steps:

machining the surfaces 78*b* and 80*b* of the rim 70 by resurfacing, grinding, or milling, machining the recess 72 by resurfacing, grinding, or milling, manufacturing the wedge 74 independently of the sector 56, and assembling the wedge 74 with the sector 56.

This method enables a better radius of curvature to be obtained at the junction between the surface 82*a* and both transverse surfaces 78*b* and 80*b* than in the method described in the preamble. In other words, the surface 82*a* is separately machined with a good flatness. The surface 82*a* is at the tip of the piece, that is connected to the adjacent surfaces of the wedge 74 by outer ridges, which are simpler to machine than inner ridges.

Mounting a wedge such as 74 on such a sector 56 of a low pressure nozzle enables the machining to be simplified, the costs thereof to be reduced, the radius of curvature between the contact surface 82*a* and the transverse surfaces to be improved, and the adjustment cost and time of the electrodes imposed by EDM to be avoided without a performance loss.

Advantageously, the casing 14 forms a rotationally blocking member of the sector 56, directly or through a non-represented slug, for example by contact on the surface 88*a* and/or the surface 88*b*, whereas the sector 56 forms a rotationally blocking member of the axially adjacent sector 26 through the wedge 74.

Thus, the reference rotationally blocking member of the sector 56 is different from the reference rotationally blocking member of the sector 26. This enables the sectors to be easily and rapidly mounted in the turbomachine.

Of course, without departing from the scope of the invention, modifications can be brought to the implementation form given as an example.

What is claimed is:

1. A nozzle sector of an aircraft turbomachine, the nozzle sector including vanes, a hooking member and a shoulder member, the hooking member having a projection radially extending towards an outside of the sector relative to the vanes, the hooking member being configured to be secured to a casing radially surrounding the nozzle sector, wherein a recess is provided through at least one part of a distal end of the projection, the recess accommodating the shoulder member, wherein the shoulder member is configured to form an anti-rotation stop for a surface of a sealing sector axially adjacent to the nozzle sector, wherein the shoulder member is configured to be mounted and secured in the recess before assembling the nozzle sector in the turbomachine.

2. The nozzle sector according to claim 1, wherein the projection has a radial portion and an axial portion extending from a distal end of the radial portion, and wherein the recess is provided through at least one part of the axial portion.

3. The nozzle sector according to claim 1, wherein the shoulder member is secured in the recess by welding, crimping, or soldering.

4. The nozzle sector according to claim 1, wherein the shoulder member radially protrudes towards the inside of the distal end of the projection.

5. The nozzle sector of an aircraft turbomachine according to claim 1, wherein the shoulder member includes a first part and a second part, the first part having a width substantially identical to the recess, the second part having a width greater than the first part.

6. The nozzle sector according to claim 5, wherein the shoulder member comprises a contact surface which is in contact with an anti-rotation projection attached to the sealing sector, and wherein the contact surface is provided on the second part of the shoulder member.

7. An assembly for a turbomachine, comprising:

a nozzle sector, and a sealing sector axially adjacent to the nozzle sector, wherein the nozzle sector includes vanes, a hooking member and a shoulder member, the hooking member having a projection radially extending towards an outside of the sector relative to the vanes, the hooking member being configured to be secured to a casing radially surrounding the nozzle sector, wherein a recess is provided through at least one part of a distal end of the projection, the recess accommodating the shoulder member, wherein the shoulder member is configured to form an anti-rotation stop for a surface of the sealing sector axially adjacent to the nozzle sector, wherein the shoulder member is configured to be mounted and secured in the recess before assembling the nozzle sector in the turbomachine, wherein the shoulder member forms an anti-rotation stop for a surface of the sealing sector, relative to the nozzle sector.

8. A turbine for a turbomachine, comprising:

an assembly according to claim 7, a turbomachine casing and an anti-rotation slug secured to the casing, wherein the anti-rotation slug and the shoulder member are each at least partially accommodated in the recess, so that the anti-rotation slug forms an anti-rotation stop of the nozzle sector relative to the casing.

9. The turbine according to claim 8, wherein the shoulder member includes a recess at least partially accommodating the anti-rotation slug.

10. An aircraft turbo-machine including a turbine according to claim 8.

11. A method for manufacturing a nozzle sector of an aircraft turbomachine, wherein the nozzle sector includes vanes, a hooking member and a shoulder member, the hooking member having a projection radially extending towards an outside of the sector relative to the vanes, the hooking member being configured to be secured to a casing radially surrounding the nozzle sector, wherein a recess is provided through at least one part of a distal end of the projection, the recess accommodating the shoulder member, wherein the shoulder member is configured to form an anti-rotation stop for a surface of a sealing sector axially adjacent to the nozzle sector, wherein the shoulder member is configured to be mounted and secured in the recess before assembling the nozzle sector in the turbomachine, wherein the method includes the following steps:

machining a surface of a projection of said sector, wherein the surface of the projection is configured to form an inner ridge with a contact surface of a shoulder member, machining a recess through at least one part of a distal end of the projection, manufacturing said shoulder member, assembling said shoulder member in the recess of the nozzle sector.

12. The manufacturing method according to claim 11, wherein machining the recess and/or machining the surface of the projection is performed by resurfacing, grinding, or milling.

13. The manufacturing method according to claim 11, including a step of securing the shoulder member in the recess by welding, crimping, or soldering.

* * * * *